United States Patent [19]

McFarland

[11] 4,084,571

[45] Apr. 18, 1978

[54] SEE-THROUGH OVEN DOOR WITH RETICULATED HEAT SHIELD

[75] Inventor: Robert Henry McFarland, Mansfield, Ohio

[73] Assignee: The Tappan Company, Mansfield, Ohio

[21] Appl. No.: 724,946

[22] Filed: Sep. 20, 1976

[51] Int. Cl.[2] ..... F23M 7/04

[52] U.S. Cl. ..... 126/198; 126/200

[58] Field of Search ..... 126/198, 200; 52/304, 52/616; 219/391, 322, 396, 397, 398

[56] References Cited

U.S. PATENT DOCUMENTS

| | | | |
|---|---|---|---|
| 3,177,334 | 4/1965 | Kinkle | 126/200 |
| 3,304,401 | 2/1967 | Long | 126/200 |
| 3,664,326 | 5/1972 | Mills | 126/200 |
| 3,710,776 | 1/1973 | Frick | 126/200 |
| 3,877,460 | 4/1975 | Lotz et al. | 126/200 |
| 3,893,442 | 7/1975 | Nuss | 126/198 |
| 4,020,826 | 5/1977 | Mole | 126/270 |

*Primary Examiner*—John J. Camby
*Assistant Examiner*—Larry I. Schwartz
*Attorney, Agent, or Firm*—Maky, Renner, Otto & Boisselle

[57] ABSTRACT

An air cooled and insulated, see-through oven door for pyrolytic self-cleaning ovens including a reticulated metallic heat shield positioned between an inner glazed window pack assembly and an outer glass panel. Such reticulated heat shield has an inner reflective surface facing the oven cavity to assist in retaining heat and a black outer surface facing outwardly to reduce the reflection of outside light for improved viewing of the oven cavity through the door.

10 Claims, 3 Drawing Figures

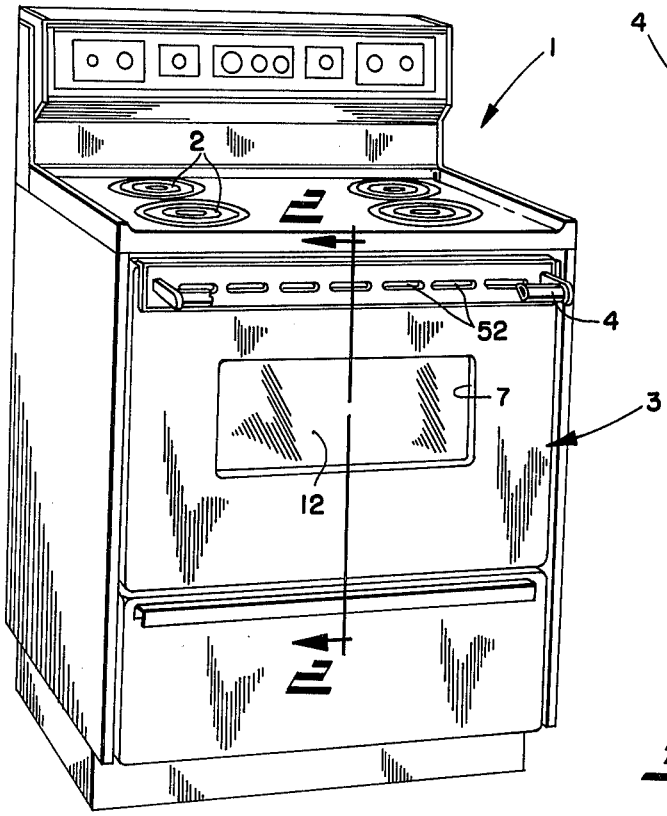
FIG. 1
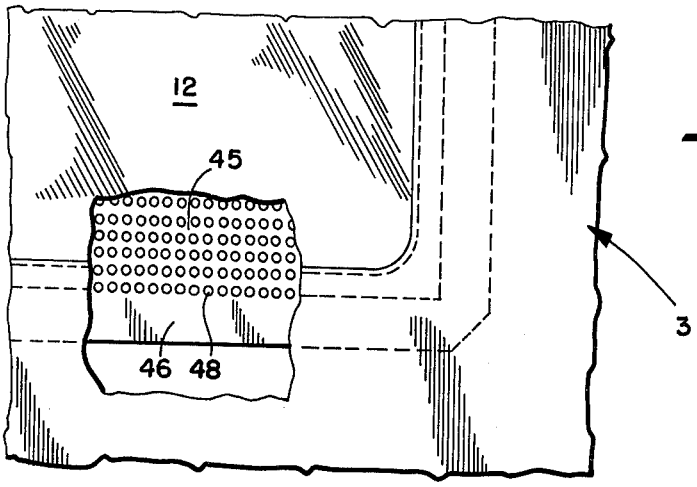
FIG. 3
FIG. 2
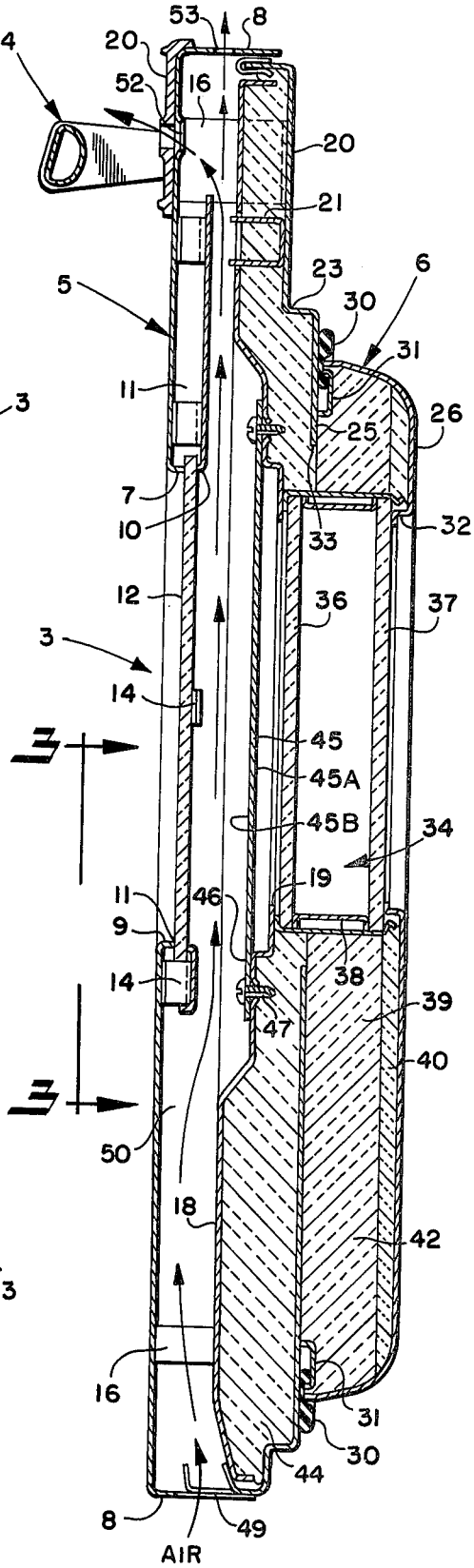

SEE-THROUGH OVEN DOOR WITH RETICULATED HEAT SHIELD

BACKGROUND OF THE INVENTION

The present invention relates generally as indicated to see-through oven doors for pyrolytic self-cleaning ovens and in particular to such doors including a reticulated metallic heat barrier therein.

Over the years, many different types of insulated see-through oven doors having air flow therethrough for cooling purposes have been developed for domestic oven use to permit viewing of the cooking process in the oven cavity while maintaining the external surface temperature of the door at sufficiently cool temperatues to avoid personal injury. Examples of such air-cooled, see-through doors which are relatively satisfactory for non-self-cleaning ovens may be found in U.S. Pat. Nos. 3,855,994; 3,818,890 and 3,828,763.

However, such doors have generally not proved adequate for use with pyrolytic self-cleaning ovens in that in general they have not been sufficiently effective in keeping the external surface temperatures of the ovens below certain desired maximum levels. In an attempt to overcome such surface temperature problem, some rather sophisticated and expensive door constructions have been devised in an effort to provide a see-through door capable of use in combination with a pyrolytic self-cleaning oven. An example of such a sophisticated and relatively expensive door arrangement may be found in U.S. Pat. No. 3,881,462 in which a shutter arrangement is used to cover the windows during the heat cleaning cycle.

SUMMARY OF THE INVENTION

With the foregoing in mind, a principal object of the present invention is to provide a see-through door of relatively simple and inexpensive construction capable of meeting the external surface temperature requirements when in use with all types of oven cavities including pyrolytic self-cleaning cavities. These and other objects of the present invention are achieved by providing an insulated air-cooled door having a reticulated metal heat shield positioned therein between an inner window pack assembly and an outer glass window. Such reticulated metallic shield permits viewing of the oven cavity in all phases of operation while assisting in keeping the external surface temperature of the door below required levels. The inner side of the shield facing the oven cavity is reflective and the side facing outwardly is black. The reflective surface facing the oven cavity assists in retaining the heat therewithin, and the black surface facing outwardly reduces the reflection of outside light to improve viewing of the interior of the oven cavity through the door.

Other objects and advantages of the present invention will become apparent as the following description proceeds.

To the accomplishment of the foregoing and related ends the invention, then, comprises the features hereinafter fully described and particularly pointed out in the claims, the following description and the annexed drawing setting forth in detail a certain illustrative embodiment of the invention, this being indicative, however, of but one of the various ways in which the principle of the invention may be employed.

BRIEF DESCRIPTION OF THE DRAWING

In the annexed drawing:

FIG. 1 is a perspective view of a free-standing domestic range having the see-through door of the present invention, with the handle therefor being broken away to illustrate a series of air egress ports;

FIG. 2 is a sectional elevation taken substantially along the line 2—2 in FIG. 1 illustrating the internal construction of the door and the present invention; and FIG. 3 is a fragmentary elevation taken along line 3—3 in FIG. 2 partially broken away to illustrate the details of the perforated metallic heat shield.

DESCRIPTION OF THE PREFERRED EMBODIMENT

Referring now in more detail to the drawing and initially to FIG. 1, a free-standing domestic range, indicated generally at 1, includes surface heating elements 2 and a self-cleaning, forwardly opening oven cavity closed by the see-through oven door 3 of the present invention. Such door 3 is pivoted along its bottom to the range cabinet by conventional hinge means to provide a drop-type door that may be opened and closed by handle 4 mounted thereon.

Referring now to FIG. 2, the see-through door 3 includes a front or external path indicated generally at 5 and an inner frame indicated generally at 6 connected to and spaced from such outer panel 5. The front panel 5 is formed from sheet metal having a generally rectangular central opening 7 and a generally rearwardly directed peripheral flange 8. The central rectangular opening 7 is formed by the sheet metal being reversely bent at 9 to define an internal channel 10 therearound, the bend 9 forming a peripheral web having a slot 11 therein respectively to receive the edges of a plate of clear, fully tempered glass 12. Such glass is positively retained in such position by a plurality of peripherally spaced retainer clips 14 positioned and held in channel 10.

The front panel 5 is mounted on the inner frame 6 by a plurality of spacers 16 extending therebetween and being interconnected therewith by suitable fasteners (not shown). As will be noted in FIG. 2, the inner frame 6 is partially telescopically received within the rearwardly directed flange 8 on front panel 5 to provide a unitary appearance for the door.

The inner frame 6 includes a stepped front wall 18 having a central rectangular opening 19 therein generally corresponding in geometrical extent to the opening 7 in front panel 5. The stepped front wall 18 is connected to a frame back wall 20 by a reinforcing channel 21 extending generally horizontally across substantially the entire width of the door. The back wall 20 is stepped toward the oven cavity at 23 and then extends generally vertically as viewed in FIG. 2 to form a partition 25 between the wall 18 and the pan shaped inner liner 26. The intersection of the pan shaped liner 26 and partition 25 is provided with a generally U-shaped, peripherally continuous seal 30 held in place by seal mounting clamp 31. When the door is in the vertical or closed position illustrated in FIG. 1, the pan shaped inner liner 26 is received within the opening for the oven cavity with the seal 30 engaging a flat surface on the cabinet about such cavity opening to provide a tight seal therebetween.

The pan shaped inner liner 26 and partition 25 are provided with generally rectangular central openings 32 and 33 respectively, that are in alignment with opening 19 in the front wall 18 of frame 6. A window pack, indicated generally at 34, is received within such aligned openings and is secured to the walls of inner frame 6 in such position. Such window pack 34 preferably includes two panes 36 and 37 of a suitable glass material such as borosilicate held in spatially fixed relationship by separator 38. The surfaces of panes 36 and 37 facing inwardly or toward the oven cavity are desirably coated with a Marsco or other such heat barrier glaze to assist in retaining the heat within the oven cavity.

To further assist in retaining the heat within the cavity, the void space 39 within the inner frame 6 between the front wall 18 and inner liner 26 thereof is filled with plural layers of insulation material, three such layers being shown. The first layer 40, which is positioned in the pan-shaped inner liner 26 most closely adjacent the oven cavity, may be approximately ¼ inch thick before compression mounting, and is preferably of a high temperature type insulation, such as Cerefelt Type CRF 400. The additional space between first layer 40 and partition 25 is filled with a second layer of insulation 42, preferably approximately 2 inches in thickness before compression, and preferably of a fiberglass-wool type insulating material. The remaining volume of the frame 6 between partition 25 and front wall 18 is filled with a third layer of insulation 44, which may also be approximately 2 inches thick before compression and made of a suitable fiberglass-wool type insulating material.

Retention of the oven cavity heat is also aided by providing a perforated or reticulated metallic shield 45 across the opening 19 in front wall 18 of inner frame 6 outwardly of window pack 34. The imperforate marginal edges 46 of the shield 45 are secured to the wall 18 by suitable fasteners 47. As best seen in FIG. 3, the shield 45 has a series of holes 48 therein to permit viewing through the shield into the oven cavity. The inner surface 45A of the shield 45 facing the oven cavity is highly reflective to assist in retaining the heat within the cavity, and the other, outwardly directed, surface 45B of the reticulated shield is preferably black to reduce the light reflection for better viewing. While other materials may be used, the shield is preferably made of anodized aluminum because it is exceedingly bright insofar as heat reflectivity is concerned, and is also a relatively lightweight material, which is important in helping to keep the weight of the door down. In addition, aluminum is an excellent radiator and spreader of the heat that does pass through the shield, which is especially beneficial in transferring the heat from the shield to an air wash provided over the outer surface of the shield to assist in cooling the door, in a manner to be subsequently described.

The hole pattern in the shield is important in obtaining the desired compromise between maximum visibility through the shield and maximum heat reflectivity thereby. Excellent results have been obtained by arranging the holes in a grid pattern of intersecting straight horizontal and vertical rows, with 225 holes per square inch of shield surface area inside the peripheral mounting margin 46 thereof, each hole being approximately 0.045 inch in diameter on centers of 0.067 inch, thus providing a shield which is approximately 37% open.

The cool air wash is formed by creating a flow of ambient air upwardly through the space 50 between the front panel 5 and inner frame 6. To this end, a series of ports 49 is provided along the bottom extent of peripheral flange 8 on front panel 5. The top of the door 3 is provided with two sets of air egress ports. The first set 52 is at the top of the door facing outwardly as best shown in FIGS. 1 and 2, while the second set 53 is in the top extent of peripheral flange 8. As indicated by the arrows in FIG. 2, air is induced into the ports 49 by the heat present, and such air flows upwardly as a cooling air wash until it bifurcates and passes from the door through ports 52 and 53.

As should now be clear from the above description, the oven door of the present invention permits the oven cavity to be viewed through window 12, perforated screen 45, and window pack 34 during all operations of the oven including the self-cleaning cycle. The construction of such door is comparatively simple and easily manufactured, with the perforated screen 45 being a relatively low cost item that can be quickly mounted in the door assembly. Such perforated or reticulated screen in the combination described provides, for the first time, a see-through door that can meet and exceed the relatively stringent standards now required for the surface or skin temperature of the front panel 5.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. In combination with a domestic range having an oven cavity capable of being cleaned by heat, a see-through oven door comprising an outer panel containing a glass window, an inner frame inwardly spaced from and attached to said outer panel and containing a window pack aligned with said window for viewing the oven cavity, said window pack being surrounded by insulation, a reticulated metallic heat shield fixedly secured in said space between said window and window pack to assist in retaining the heat in the oven cavity and thus correspondingly to decrease the surface temperature of the outer panel and glass window, and means for circulating cooling air upwardly through the space between said outer panel and inner frame and past the reticulated metallic heat shield to provide a cooling air wash therefor to assist in decreasing the surface temperature of the outer panel and glass window.

2. The oven door defined in claim 1 wherein said reticulated metallic heat shield has a reflective inner surface facing said oven cavity to assist in retaining the heat within said oven cavity.

3. The oven door defined in claim 1 wherein said reticulated metallic heat shield is made of anodized aluminum.

4. The oven door defined in claim 3 wherein the inner surface of said anodized aluminum shield is untreated and the outer surface of said shield has a black coating thereon facing outwardly away from said oven cavity to decrease reflection of outside light for improved viewing.

5. The oven door defined in claim 1 wherein said reticulated metallic heat shield has a multitude of circular holes therein arranged in straight rows.

6. The oven door defined in claim 5 wherein approximatey 37% of said shield is open.

7. The oven door defined in claim 6 wherein there are approximately 225 holes per square inch of exposed surface of said shield.

8. The oven door defined in claim 1 wherein there are approximately 225 holes per square inch of exposed surface of said shield, each said hole being approximately 0.045 inch in diameter and located on 0.067 inch centers.

9. The oven door defined in claim 1 wherein there are at least two layers of insulation contained in said inner frame, including a first layer of high temperature insulation immediately adjacent the oven cavity.

10. The oven door defined in claim 9 wherein there are three layers of insulation contained in said inner liner, the second and third layers of insulation being of fiberglass-wool material located outwardly of said first layer of insulation and at least partially separated by a partition in said inner frame.

* * * * *